US007528800B2

(12) United States Patent
An et al.

(10) Patent No.: US 7,528,800 B2
(45) Date of Patent: May 5, 2009

(54) PLASMA DISPLAY PANEL AND DRIVING APPARATUS THEREOF

(75) Inventors: Byung-Nam An, Suwon-si (KR); Jun-Young Lee, Suwon-si (KR); Jun-Hyung Kim, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 636 days.

(21) Appl. No.: 10/964,926

(22) Filed: Oct. 15, 2004

(65) Prior Publication Data

US 2005/0083261 A1 Apr. 21, 2005

(30) Foreign Application Priority Data

Oct. 16, 2003 (KR) ..... 10-2003-0072333

(51) Int. Cl.
*G09G 3/28* (2006.01)

(52) U.S. Cl. ..... 345/60

(58) Field of Classification Search ..... 345/60–72, 345/41, 204; 315/169.3
See application file for complete search history.

(56) References Cited

U.S. PATENT DOCUMENTS

| | | | | |
|---|---|---|---|---|
| 6,034,482 | A * | 3/2000 | Kanazawa et al. | 315/169.3 |
| 6,150,767 | A * | 11/2000 | Huang | 345/60 |
| 6,281,635 | B1 * | 8/2001 | Lee | 345/60 |
| 6,608,609 | B1 * | 8/2003 | Setoguchi et al. | 345/60 |
| 6,906,690 | B2 * | 6/2005 | Lim | 345/60 |
| 6,933,679 | B2 * | 8/2005 | Lee et al. | 345/60 |
| 7,075,239 | B2 * | 7/2006 | Kang et al. | 315/169.3 |
| 7,170,472 | B2 * | 1/2007 | Park et al. | 315/169.3 |
| 7,242,373 | B2 * | 7/2007 | Tomio et al. | 345/60 |
| 2002/0186184 | A1 * | 12/2002 | Lim | 345/60 |
| 2003/0025459 | A1 * | 2/2003 | Lee et al. | 315/169.3 |
| 2003/0057851 | A1 * | 3/2003 | Roh et al. | 315/169.3 |
| 2003/0169215 | A1 * | 9/2003 | Iwami | 345/60 |
| 2003/0173905 | A1 * | 9/2003 | Lee et al. | 315/169.3 |
| 2003/0184533 | A1 * | 10/2003 | Roh et al. | 345/204 |
| 2004/0085262 | A1 * | 5/2004 | Lee | 345/41 |

FOREIGN PATENT DOCUMENTS

| | | |
|---|---|---|
| CN | 1405746 | 3/2003 |
| CN | 1448905 | 10/2003 |
| JP | 2000-020021 | 1/2000 |
| JP | 2000-122601 | 4/2000 |
| JP | 2000-172229 | 6/2000 |

(Continued)

*Primary Examiner*—Chanh Nguyen
*Assistant Examiner*—Adam J Snyder
(74) *Attorney, Agent, or Firm*—H.C. Park & Associates, PLC

(57) ABSTRACT

An apparatus for driving a plasma display panel including scan electrodes, sustain electrodes, and panel capacitors formed between the scan electrodes and the sustain electrodes is disclosed In one embodiment, the apparatus includes a scan integrated circuit for supplying a scan voltage to the scan electrodes, a sustain discharge voltage generator for applying the first voltage and the second voltage to the scan electrodes, and a rising reset waveform generator for applying a rising reset waveform rising from a third voltage to a fourth voltage to the scan electrode. In the plasma display panel according to the present invention, a transistor for applying a rising reset waveform is coupled to a transistor to eliminate a conventional main switch.

10 Claims, 4 Drawing Sheets

FOREIGN PATENT DOCUMENTS

| | | |
|---|---|---|
| JP | 2000-284745 | 10/2000 |
| JP | 2001-228821 | 8/2001 |
| JP | 2002-189443 | 7/2002 |
| JP | 2002-236468 | 8/2002 |
| JP | 2003-015593 | 1/2003 |
| JP | 2003-015600 | 1/2003 |
| JP | 2003-076323 | 3/2003 |

* cited by examiner

PLASMA DISPLAY PANEL AND DRIVING APPARATUS THEREOF

CROSS REFERENCE TO RELATED APPLICATION

This application claims priority to Korean Patent Application No. 10-2003-0072333 filed on Oct. 16, 2003 in the Korean Intellectual Property Office, the content of which is herein incorporated by reference in its entirety.

BACKGROUND OF THE INVENTION

1. Field of the Invention

The present invention relates to a driving apparatus of a plasma display panel (PDP).

2. Description of the Related Art

Various flat panel displays such as the LCD (liquid crystal display), the FED (field emission display), and the plasma display panel (PDP) have been developed. The plasma display panel has a higher resolution, a higher rate of emission efficiency, and a wider view angle in comparison with other flat panel displays. Accordingly, the plasma display panel is viewed as a display that can be substituted for the conventional cathode ray tube (CRT), especially in large-sized displays of greater than forty inches.

The plasma display panel is a flat panel display for showing characters or images using a plasma generated by gas discharge, and includes hundreds of thousands to millions of pixels arranged in a matrix format, in which the number of pixels are determined by the size of the plasma display panel. The plasma display panel is divided into a DC (direct current) plasma display panel and an AC (alternating current) plasma display panel according to applied driving voltage waveforms and structures of discharge cells.

Electrodes of the DC plasma display panel are exposed in a discharge space and the current flows in the discharge space when a voltage is applied, and therefore it is problematic to provide a resistor for current limitation. On the other hand, electrodes of the AC PCP are covered with a dielectric layer, so that currents are limited because of the natural formation of capacitance components, and the electrodes are protected from ion impulses in the case of discharging, and therefore a life span of the AC plasma display panel is longer than that of the DC plasma display panel.

FIG. 1 shows a partial perspective view of a prior art AC plasma display panel. As shown in FIG. 1, scan electrodes 4 and sustain electrodes 5 in pairs are formed in parallel on a first glass substrate 1, and are covered with a dielectric layer 2 and a protection film 3. A plurality of address electrodes 8 is established on a second glass substrate 6, and the address electrodes 8 are covered with an insulator layer 7. Barrier ribs 9 are formed in parallel with the address electrode 8 on the insulator layer 7 between the address electrodes 8, and phosphors 10 are formed on the surface of the insulator layer 7 and on the both sides of the barrier ribs 9. The first and second glass substrates 1 and 6 are provided to face with each other with a discharge spaces 11 between the glass substrates 1 and 6 so that the scan electrodes 4 and the sustain electrodes 5 may respectively cross the address electrodes 8. A discharge space 11 between the address electrode 8 and a crossing part of a pair of the scan electrode 4 and the sustain electrode 5 forms a discharge cell 12.

FIG. 2 schematically shows an electrode arrangement of a prior art plasma display panel. As shown in FIG. 2, the electrodes of the plasma display panel comprise an M×N matrix format. The address electrodes $A_1$ to $A_m$ are arranged in the column direction, and N scan electrodes $Y_1$ to $Y_n$ and sustain electrodes $X_1$ to $X_n$ are alternately arranged in the row direction. The scan electrode will be referred to as "Y electrodes"and the sustain electrodes referred to as "X electrodes. " The discharge cell 12 in FIG. 2 corresponds to the discharge cell 12 in FIG. 1.

FIG. 3 shows a diagram of a driving waveform associated with a conventional plasma display panel. According to the plasma display panel driving method shown in FIG. 3, each subfield includes a reset period, an address period, and a sustain period. In the reset period, wall charges of previous sustain-discharging are erased, and the wall charges are generated so as to perform the next address discharging stably. In the address period, cells that are turned on and those that are turned off on the panel are selected, and the wall charges are accumulated to the cells that are turned on (i.e., addressed cells). In the sustain period, discharge for substantially displaying images on the addressed cells is performed.

An operation of the plasma display panel driving method in the reset period will be described. As shown in FIG. 3, the reset period comprises a Y ramp rising period and a Y ramp falling period.

(1) Y ramp rising period

A ramp reset waveform gradually rising from a voltage of $V_S$ to a voltage of $V_{set}$ is applied to the Y electrode while the address electrode and the X electrode are maintained at 0V in the period. A first weak reset discharging is generated to the address electrode and the X electrode from the Y electrode in the discharge cells while the ramp reset waveform is rising. Accordingly, (−) wall charges are accumulated on the Y electrode, and (+) charges are concurrently accumulated on the address electrode and the X electrode.

(2) Y ramp falling period

A ramp reset waveform gradually falling from a voltage of $V_S$ to a negative voltage of $V_{nf}$ is applied to the Y electrode while the X electrode is maintained at a constant voltage of $V_e$. A second weak reset discharging is generated in the discharge cells while the ramp reset waveform is falling.

FIG. 4 shows a diagram of a conventional plasma display panel driving circuit for realizing the driving waveforms shown in FIG. 3. According to the conventional driving circuit shown in FIG. 4, a main switch $Y_{pp}$ is necessary for separating a voltage applied in the Y ramp rising period (a period in which a voltage applied to a panel capacitor rises to the voltage of $V_{set}$ from the voltage of $V_S$ when a switch $Y_\pi$ is turned on) from the voltage of $V_S$. A plurality of field effect transistors (FETs) coupled in parallel are substantially necessary because the main switch $Y_{pp}$ is provided on a main discharge path. Therefore it is problematic that a size of entire board and a cost are increased because impedance and the number of parts of a circuit are increased according the conventional driving circuit. It is also problematic that increased impedance on the main path according to the conventional driving circuit has an effect on a discharge margin in the case of the sustain discharging.

SUMMARY OF THE INVENTION

One embodiment of the invention provides a plasma display panel having a reduced number of parts in a circuit and a reduced impedance of a main path and a driving apparatus thereof.

In one aspect of the present invention, an apparatus for driving a plasma display panel including scan electrodes, sustain electrodes, and panel capacitors formed between the scan electrodes and the sustain electrodes includes: a scan integrated circuit having a first transistor and a second transistor a node of which is coupled to the scan electrodes. In operation the scan integrated circuit supplies a scan voltage to the scan electrodes. A sustain discharge voltage generator is included that has a third transistor and a fourth transistor coupled in series between a first voltage and a second voltage, and a node of which is coupled to the scan electrodes. In operation the sustain discharge voltage generator applies the first voltage and the second voltage to the scan electrodes. Also included is a rising reset waveform generator that has a first capacitor of which a terminal is coupled to a node between the third transistor and the fourth transistor, and a fifth transistor coupled to another terminal of the first capacitor and the first transistor. In operation the rising reset waveform generator applies a rising reset waveform rising from a third voltage to a fourth voltage to the scan electrode.

In another aspect of the present invention, an apparatus for driving a plasma display panel including scan electrodes, sustain electrodes, and panel capacitors formed between the scan electrodes and the sustain electrodes includes: a scan integrated circuit having a first transistor and a second transistor a node of which is coupled to scan electrodes. The scan integrated circuit supplies a scan voltage to the scan electrodes. Also included is a sustain discharge voltage generator having a third transistor and a fourth transistor coupled in series between a first voltage and a second voltage, and node of which is coupled to the scan electrodes. The sustain discharge voltage generator applies the first voltage or the second voltage to the scan electrodes. Further included is a rising reset waveform generator including a fifth transistor coupled to a third voltage and the first transistor. The rising reset waveform generator applies a rising reset waveform to the scan electrode.

In another aspect of the present invention, an apparatus for driving a plasma display panel including a scan integrated circuit having a first transistor and a second , and a node is coupled to scan electrodes, and supplying a scan voltage to the scan electrodes, and the apparatus including a sustain discharging circuit for applying a sustain discharge voltage to the scan electrode includes: a first current path for applying a rising reset waveform to the scan electrode through the first transistor of the scan integrated circuit; and a second current path for applying the sustain discharge voltage to the scan electrode through the second transistor of the scan integrated circuit.

In another aspect of the present invention, a plasma display panel includes: a plasma panel having a plurality of address electrodes arranged in the column direction, scan electrodes and sustain electrodes alternately arranged in the row direction; and a scan driver for supplying a scan voltage and a sustain discharge voltage to the scan electrode. The scan driver may further include.

1 a scan integrated circuit having a first transistor and a second transistor a node of which is coupled to the scan electrode. The scan integrated circuit supplies the scan voltage to the scan electrode.

A sustain discharge voltage generator is included that has a third transistor and a fourth transistor coupled in series between a first voltage and a second voltage, a node of which is coupled to the scan electrodes. The sustain discharge voltage generator applies the first voltage or the second voltage to the scan electrodes. Further included is a rising reset waveform generator having first capacitor of which a terminal is coupled to a node between the third transistor and the fourth transistor, and a fifth transistor coupled to another terminal of the first capacitor and the first transistor.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Figure 1:
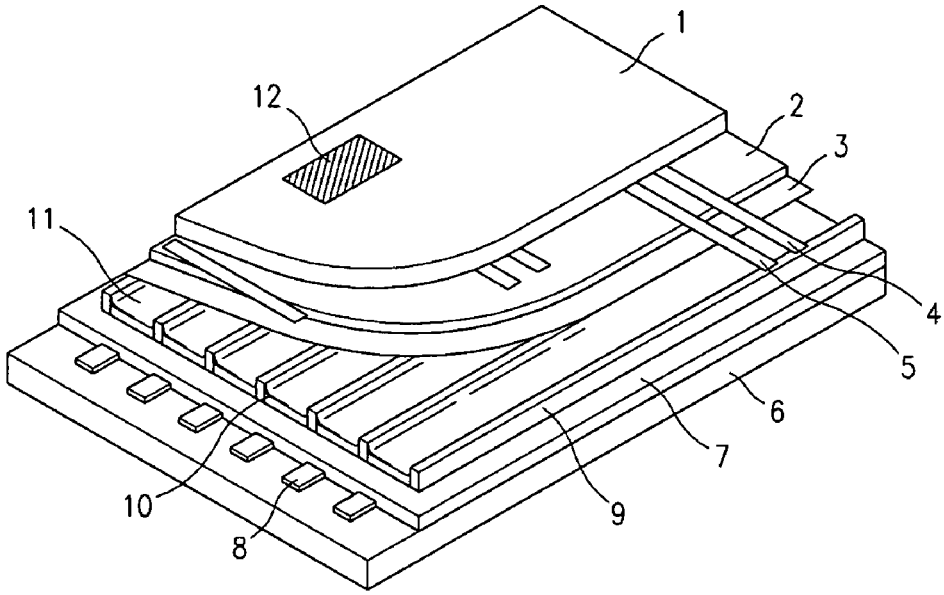
FIG.1 (Prior Art)
FIG. 1 shows a partial perspective view of a conventional AC (alternating current) plasma display panel (PDP).
Figure 2:
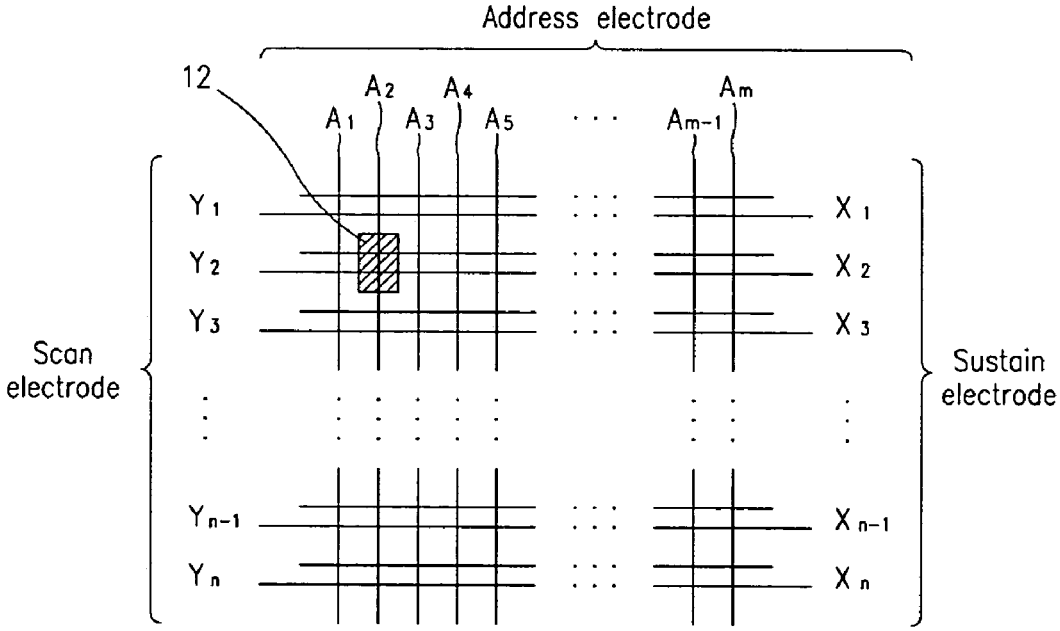
FIG.2 (Prior Art)
FIG. 2 shows an electrode arrangement of a conventional plasma display panel.
Figure 3:
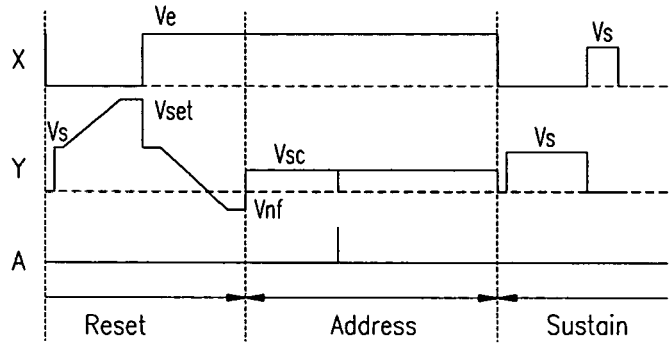
FIG.3 (Prior Art)
FIG. 3 shows a diagram of a driving waveform associated with a conventional plasma display panel.

In the following detailed description, only the preferred embodiment of the invention is shown and described, along with the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive. To clarify the present invention, parts which are not described in the specification are omitted, and parts for which similar descriptions are provided have the same reference numerals.

Figure 5:
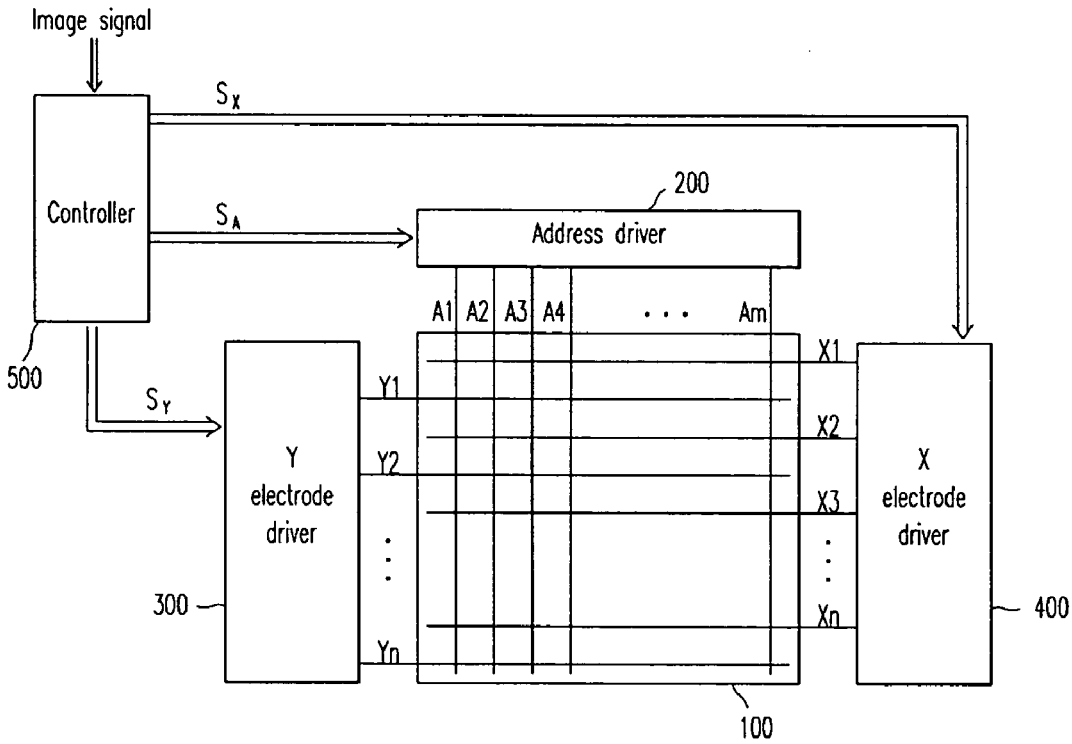
FIG. 5 shows a diagram for representing a configuration of a plasma display panel according to an exemplary embodiment of the present invention.

FIG. 5 shows a diagram representing a configuration of plasma display panel according to an exemplary embodiment of the present invention. As shown in FIG. 5, the plasma display panel may include: a plasma panel 100, an address driver 200, a Y electrode driver 300, an X electrode driver 400, and a controller 500.

The plasma panel 100 includes a plurality of address electrodes $A_1$~$A_m$ arranged in the column direction, and first scan electrodes $Y_1$~$Y_n$ and second sustain electrodes $X_1$~$X_n$ arranged alternately in the row direction.

In operation the address driver 200 receives an address driving control signal SA from the controller 500 and applies a display data signal for selecting discharge cells to be displayed to each address electrode. The Y electrode driver 300 and the X electrode driver 400 receive a Y electrode driving signal SY and an X electrode driving signal SX from the controller 500 respectively, and apply the same to the X electrode and the Y electrode. The controller 500 receives an external image signal, generates an address driving control signal SA, a Y electrode driving signal SY, and an X electrode driving signal SX, and transmits them to the address driver 200, the Y electrode driver 300, and the X electrode driver 400 respectively.

Figure 6:
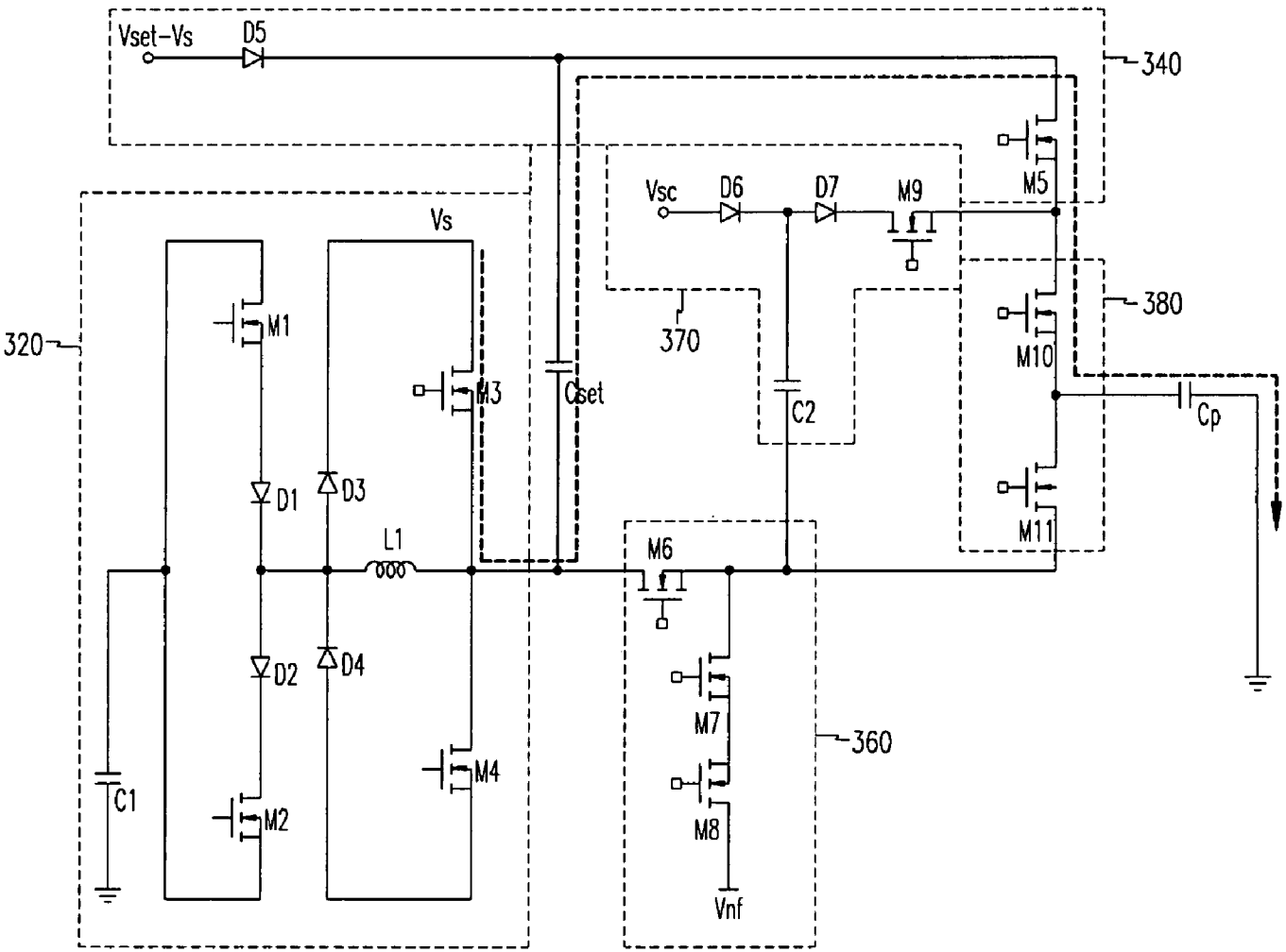
FIG. 6 shows a diagram of a plasmas display panel driving circuit according to an exemplary embodiment of the present invention.

FIG. 6 shows a detailed diagram of a plasma display panel driving circuit according to an exemplary embodiment of the present invention.

The Y electrode driver according to the exemplary embodiment of the present invention may include a sustain discharge voltage generator 320, a Y rising reset waveform generator 340, a Y falling reset waveform generator 360, a scan voltage generator 370, and a scan integrated circuit (IC) 380.

The sustain discharge voltage generator 320 may include transistors M1, M2, M3, and M4, diodes D1, D2, D3, and D4, an inductor L1, and a capacitor C1. The transistors M3 and M4 are coupled in series between the sustain discharge voltage of $V_S$ and the ground voltage, and are switches for supplying the voltage of $V_S$ and the ground voltage to a panel capacitor Cp respectively. The capacitor C1, the inductor L1, and the transistors M1 and M2 form an energy recovery circuit, and charge a voltage at the panel capacitor Cp with the voltage of $V_S$ or discharge the same to the ground voltage.

The scan integrated circuit 380 may include transistors M10 and M11 coupled to the scan electrode (a terminal of the panel capacitor), and sequentially supplies the scan voltage Vsc to the scan electrode (Y electrode) of the plasma display panel.

The scan voltage generator 370 may include diodes D6 and D7, a capacitor C2, and a transistor M9. The scan voltage generator 370 supplies the scan voltage $V_{SC}$ to a drain of the transistor M10 of the scan integrated circuit 380 through the diodes D6 and D7 and the transistor M9.

The Y rising reset waveform generator 340 comprises a diode D5, a capacitor $C_{set}$, and a transistor M5, and applies a rising reset waveform rising from the voltage of $V_S$ to the voltage of $V_{set}$ to the panel capacitor Cp. The capacitor $C_{set}$ is coupled to a node between the transistors M3 and M4 and a drain of the transistor M5, and a source of the transistor M5 is coupled to the transistor M10 of the scan integrated circuit 380.

The Y falling reset waveform generator 360 may include transistors M6, M7 and M8, and applies a falling reset waveform falling from the voltage of $V_S$ to the negative voltage of $V_{nf}$ to the panel capacitor Cp. The transistor M6 is coupled to the node between the transistors M3 and M4, and the transistor M11 of the scan integrated circuit 380.

Figure 4:
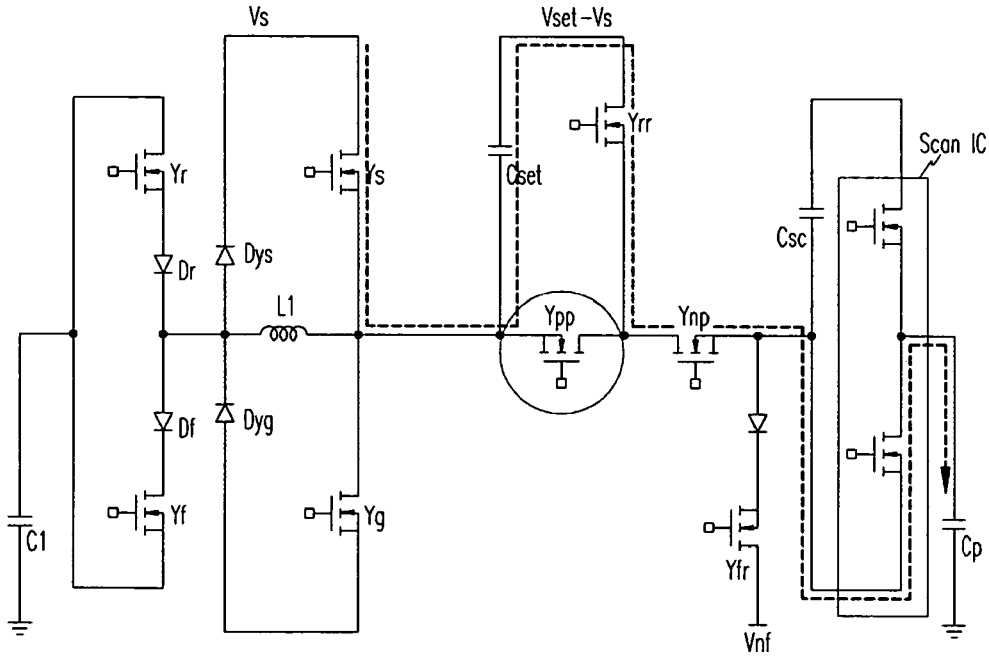
FIG.4 (Prior Art)
FIG. 4 shows a diagram of a conventional plasma display panel driving circuit for realizing the driving waveforms shown in FIG. 3.

According to the driving circuit shown in FIG. 6, the transistor M5 for applying the rising reset waveform is coupled to the transistor M10 of the scan integrated circuit 380. This eliminates the main switch $Y_{pp}$ shown in FIG. 4. Illustratively, the transistor M5 according to the exemplary embodiment of the present invention is realized by using one FET because the transistor M5 is not provided on the main discharge path.

As described, the circuit impedance is minimized and a distortion of the sustain discharge voltage is reduced because the conventional main switch $Y_{pp}$ which is provided on the main path is eliminated according to the exemplary embodiment of the present invention. Also, it is an advantage that the number of parts of the circuit and the size of the board are reduced because the main switch formed with a plurality of the FETs coupled in parallel on the main path is eliminated according to the exemplary embodiment of the present invention.

The driving method according to the exemplary embodiment of the present invention will be described with reference to FIG. 6.

(1) Reset period

The capacitor $C_{set}$ is assumed to be charged with a voltage of $V_{set}$-$V_S$ , which is easily performed by turning on the transistor M4. The transistors M4, M6, M7, M8, M9, and M11 are turned off and the transistors M5 and M10 are turned on while the transistor M3 is turned on. The voltage of $V_S$ is supplied to a first terminal of the capacitor C1, and a voltage at a second terminal of the capacitor C1 becomes the voltage of $V_{set}$ because the capacitor C1 is pre-charged with the voltage of $V_{set}$-$V_S$. The voltage of $V_{set}$ at the second terminal of the capacitor C1 is supplied to a first terminal (the Y electrode) of the panel capacitor Cp through the transistor M5 and the transistor M10 of the scan integrated circuit 380. At this time, a voltage rising to the voltage of $V_{set}$ from the voltage of $V_S$ is applied to the first terminal (Y electrode) of the capacitor Cp because the transistor M5 is a ramp switch for flowing the constant currents between the source/drain. As described, according to the exemplary embodiment of the present invention, an external power supply voltage for applying the voltage of $V_{set}$ to the Y electrode is reduced to the voltage of $V_{set}$-Vs because the voltage of $V_{set}$-$V_S$ is pre-charged by using the capacitor $C_{set}$.

In one embodiment, when the transistors M6 and M11 are turned on, the transistors M5 and M10 are turned off, and the voltage of $V_S$ is then applied to the Y electrode.

In one embodiment, when the transistor M6 is turned off, and the transistors M7 and M8 are turned on, the voltage at the first terminal (Y electrode) of the panel capacitor (Cp) falls from the voltage of $V_S$ to the negative voltage of $V_{nf}$.

(2) Address period

While the transistors M5 and M6 are turned off, the scan voltage is applied to the Y electrode by the selectively turning on the transistors M10 and M9 of the scan integrated circuit. That is, when the Y electrode performs no scan operation in the address period, the transistors M10 and M11 are turned on to apply a low voltage of $V_{nf}$ to the Y electrode; and when the Y electrode performs the scan operation, the transistor M10 is turned on and the transistor M11 is turned off to apply the scan voltage of $V_{SC}$ to the Y electrode.

(3) Sustain discharging period

The transistors M5, M10, M7, and M8 are turned off and the transistor M6 provided on the main path is turned on. By selectively controlling the operation of the transistors M1, M2, M3, M4, the sustain discharge voltage of $V_S$ and the ground voltage are supplied to the Y electrode (panel capacitor (Cp)) through the transistor M11 of the scan integrated circuit.

At this time, the capacitor C1, the inductor L1, and the transistors M1 and M2 form an energy recovery circuit, and charge the panel capacitor Cp with the voltage of $V_S$ or discharge the same to the ground voltage.

Illustratively, the external power supply voltage (the voltage of $V_{set}$-$V_S$) is reduced by the capacitor $C_{set}$ in the exemplary embodiment of the present invention shown in FIG. 6, and it is also possible to eliminate the capacitor $C_{set}$ and use the voltage of $V_{set}$ as the external power supply voltage.

While a ramp waveform as an example of the rising and the falling reset waveforms has been described according to the exemplary embodiment of the present invention, other waveforms such as logarithmic waveforms are also used as the rising and the falling reset waveforms.

As described, the circuit impedance is minimized and a distortion of the sustain discharge voltage is reduced because the transistor for applying the rising reset waveform is coupled to the transistor of the scan integrated circuit according to the exemplary embodiment of the present invention to eliminate the conventional main switch Ypp.

The number of parts of the circuit and the size of the board are advantageously reduced because the main switch formed with a plurality of the FETs coupled in parallel on the main path is eliminated according to the exemplary embodiment of the present invention.

While the invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. An apparatus for driving a plasma display panel including scan electrodes, sustain electrodes, and panel capacitors formed between the scan electrodes and the sustain electrodes, comprising:

a scan integrated circuit having a first transistor and a second transistor, the scan integrated circuit to supply a scan voltage to the scan electrodes, wherein a node between the first transistor and the second transistor is coupled to the scan electrodes;

a sustain discharge voltage generator including a third transistor and a fourth transistor coupled in series between a first voltage and a second voltage, the sustain discharge voltage generator to apply the first voltage and the second voltage to the scan electrodes, wherein a node between the third transistor and the fourth transistor is coupled to the scan electrodes; and a rising reset waveform generator including a first capacitor, a terminal of which is coupled to the node between the third transistor and the fourth transistor, and a fifth transistor having a first terminal coupled to another terminal of the first capacitor and a second terminal directly coupled to the first transistor, the second terminal of the fifth transistor being not directly coupled to the second transistor, the rising reset waveform generator to apply a rising reset waveform rising from a third voltage to a fourth voltage to the scan electrode via a current path including the capacitor, the fifth transistor, and the first transistor, wherein the first transistor and the fifth transistor are turned on to form the current path.

2. The apparatus of claim 1, further comprising a falling reset waveform generator including a sixth transistor coupled to the node between the third transistor and the fourth transistor, and the second transistor, and a seventh transistor coupled to a fifth voltage and the second transistor, the falling reset waveform generator to apply a falling reset waveform falling to the fifth voltage to the scan electrodes.

3. The apparatus of claim 2, further comprising a scan voltage generator including an eighth transistor coupled to the first transistor, the scan voltage generator to supply the scan voltage to the first transistor through the eighth transistor.

4. The apparatus of claim 1, wherein the first voltage is a sustain discharge voltage and the second voltage is a ground voltage.

5. The apparatus of claim 1, wherein the first capacitor is charged with a voltage corresponding to a difference between the fourth voltage and the third voltage.

6. The apparatus of claim 1, further comprising a sixth transistor coupled between the node between the third transistor and the fourth transistor, and the second transistor.

7. The apparatus of claim 6, wherein the rising reset waveform is applied to the scan electrode through the fifth transistor and the first transistor, and the first voltage or the second voltage is applied to the scan electrode through the sixth transistor and the second transistor.

8. A plasma display panel, comprising:

a plasma panel including a plurality of address electrodes arranged in the column direction, scan electrodes and sustain electrodes alternately arranged in the row direction, and a scan driver for supplying a scan voltage and a sustain discharge voltage to the scan electrode, wherein the scan driver comprises:

a scan integrated circuit having a first transistor and a second transistor, the scan integrated circuit to supply the scan voltage to the scan electrode, wherein a node between the first transistor and the second transistor is coupled to the scan electrodes;

a sustain discharge voltage generator including a third transistor and a fourth transistor coupled in series between a first voltage and a second voltage, the sustain discharge voltage generator to apply the first voltage and the second voltage to the scan electrodes, wherein a node between the third transistor and the fourth transistor is coupled to the scan electrodes; and a rising reset waveform generator including a first capacitor, a terminal of which is coupled to the node between the third transistor and the fourth transistor, and a fifth transistor having a first terminal coupled to another terminal of the first capacitor and a second terminal directly coupled to the first transistor, the second terminal of the fifth transistor being not directly coupled to the second transistor, wherein the first transistor and the fifth transistor are turned on to form a current path including the capacitor, the fifth transistor, and the first transistor, and a rising reset waveform rising from a third voltage to a fourth voltage is applied to the scan electrode via the current path.

9. The plasma display panel of claim 8, further comprising a falling reset waveform generator including a sixth transistor coupled to the node between the third transistor and the fourth transistor, and the second transistor, and a seventh transistor coupled to a third voltage and the second transistor.

10. The plasma display panel of claim 9, further comprising a scan voltage generator including an eighth transistor coupled to the first transistor, the scan voltage generator to supply the scan voltage to the first transistor through the eighth transistor.

* * * * *